United States Patent [19]

Imaeda

[11] Patent Number: 5,045,888

[45] Date of Patent: Sep. 3, 1991

[54] IMAGE FIXING DEVICE AND METHOD FOR FIXING IMAGE

[75] Inventor: Mikio Imaeda, Bisai, Japan

[73] Assignee: Brother Kogyo Kabushiki Kaisha, Aichi, Japan

[21] Appl. No.: 521,359

[22] Filed: May 10, 1990

[30] Foreign Application Priority Data

May 30, 1989 [JP] Japan ..... 1-136560
Jul. 5, 1989 [JP] Japan ..... 1-173744
Aug. 11, 1989 [JP] Japan ..... 1-208958

[51] Int. Cl.[5] ..... G03G 15/20

[52] U.S. Cl. ..... 355/282; 354/351; 355/200

[58] Field of Search ..... 355/200, 210, 27, 282, 355/285, 289, 290; 354/351, 352, 353; 219/216

[56] References Cited

U.S. PATENT DOCUMENTS 4,549,803 10/1985 Ohno et al. ..... 219/216 X
4,780,742 10/1988 Takahashi et al. ..... 355/290
4,908,669 3/1990 Yamamoto ..... 355/282

*Primary Examiner*—R. L. Moses
*Assistant Examiner*—Thu A. Dang
*Attorney, Agent, or Firm*—Oliff & Berridge

[57] ABSTRACT

An image fixing device supplies transparent resin particles over an output imaging surface of an image recording medium. The resin particles are electrostatically attracted onto the image recording medium, and are fused for providing the transparent protective resin layer. The device includes a device for mounting the recording medium with the imaging surface facing outwardly (transfer drum), a device for accumulating a material of the resin layer, a device for supplying the material on the accumulating device toward the imaging surface, the supplying device being positioned in the accumulating device and a device for applying the material onto the imaging surface, the applying device being positioned between the supplying device and mounting device.

20 Claims, 4 Drawing Sheets

IMAGE FIXING DEVICE AND METHOD FOR FIXING IMAGE

BACKGROUND OF THE INVENTION

The present invention relates to an image fixing device for fixing an image on an image carrying member, and a method for fixing the image, and more particularly, to the image fixing device and method for forming a transparent protective coating layer over an image formed on the image carrying member.

In a conventional electrophotographic method, an electrostatic latent image is formed upon image exposure on a photosensitive member whose surface has been uniformly charged with electricity by a corona discharge, and then wet type developing is conducted by using a liquid developing agent. In the liquid developing agent, only a small amount of image fixing resin is contained, and therefore, the resultant fixed image is easily damaged and contaminated with foreign objects. Further, if the photosensitive member is formed of a photosensitive material in which photoconductive minute particles such as zinc oxide and titanium oxide particles are dispersed in a resin binder, a surface of the photosensitive member is of porous structure. Therefore, an output image formed on the surface of the porous photosensitive member is not flat but becomes matte form. Accordingly, diffused reflection may occur at the surface of the output image, and consequently, high density output image may not be obtainable.

To overcome this drawback, there is known a method for forming a protective coating layer formed of a resin binder over the output electrophotographic image for image fixing. For example, according to one conventional image fixing method, a resin solution in which a resin binder is dissolved in an organic solvent is coated on a surface of the output image, and then the solution is subjected to drying to obtain a transparent protective layer. However, in this method, a conflicting problem may occur in view of the transparency and mechanical strength of the protective coating layer on one hand and insolubility of the photosensitive material and image fixing resin into the solvent of the resin solution which constitute the protective coating layer on the other hand. That is, the protective coating layer must provide sufficient strength and transparency. On the other hand, the output image must not be degraded due to the solubility of the photosensitive material and the image fixing resin into the solvent which is used for dissolving the resin binder for forming the protective layer. Taking the two aspects into consideration, the available kind of solvent undergoes restriction so as to meet with the conflicting requirement of transparency and insolubility.

Further, if the electrophotographic output image is obtained by the wet type developing method, and if the above described method is conducted for forming, the protective coating layer over the image, another disadvantage may occur in that two solvent drying processes are required, which leads to excessive energy consumption, and further, the solvent is evaporated in the atmosphere due to the drying process which may cause environmental pollution.

Another conventional method for forming the protective coating layer is known. In this method, thermal melting type transparent resin layer is formed over a substrate sheet, and the substrate sheet carrying the resin layer is thermally melted on the output image surface and thereafter, the substrate sheet is solely peeled off for finally forming a transparent resin layer over the surface of the output image. However, this method requires a separate substrate sheet whose area must be the same as that of the electrophotographic output image. Therefore, a great number of substrate sheets must be stored in an image forming apparatus. Further, the resultant output image becomes costly, since the substrate sheet is finally removed.

SUMMARY OF THE INVENTION

It is therefore, an object of the present invention to overcome the above described drawbacks and deficiencies, and to provide an improved device and method for fixing an output image by coating a transparent protective layer thereover.

Another object of the invention is to provide a such device and method for forming the transparent protective coating layer over the output image surface with reducing diffused reflection and enhancing a quality of the output image without any damage to the surface and contamination with foreign objects.

Still another object of the invention is to provide a such device and method capable of providing such protective coating layer at low cost.

These and other objects of the present invention will be attained by providing an image fixing device for fixing an output image on an imaging surface of an image recording medium by providing a transparent protective resin layer over the imaging surface, the device comprising means for mounting the recording medium with the imaging surface facing outwardly, means for accumulating a material of the resin layer, means for supplying the material on the accumulating means toward the imaging surface, the supplying means being positioned in the accumulating means, and means for applying the material onto the imaging surface, the applying means being positioned between the supplying means and mounting means.

In another aspect of the present invention, there is provided an image fixing method for fixing an output image on an imaging surface of an image recording medium by providing a transparent protective resin layer over the imaging surface, the method comprising the steps of mounting the image recording medium on an image recording medium mounting means with the imaging surface facing outwardly, applying a material of the resin layer over the imaging surface, and heating the material of the resin layer for providing an integral transparent resin layer over the imaging surface.

DETAILED DESCRIPTION OF THE PREFERRED EMBODIMENTS

Figure 1:
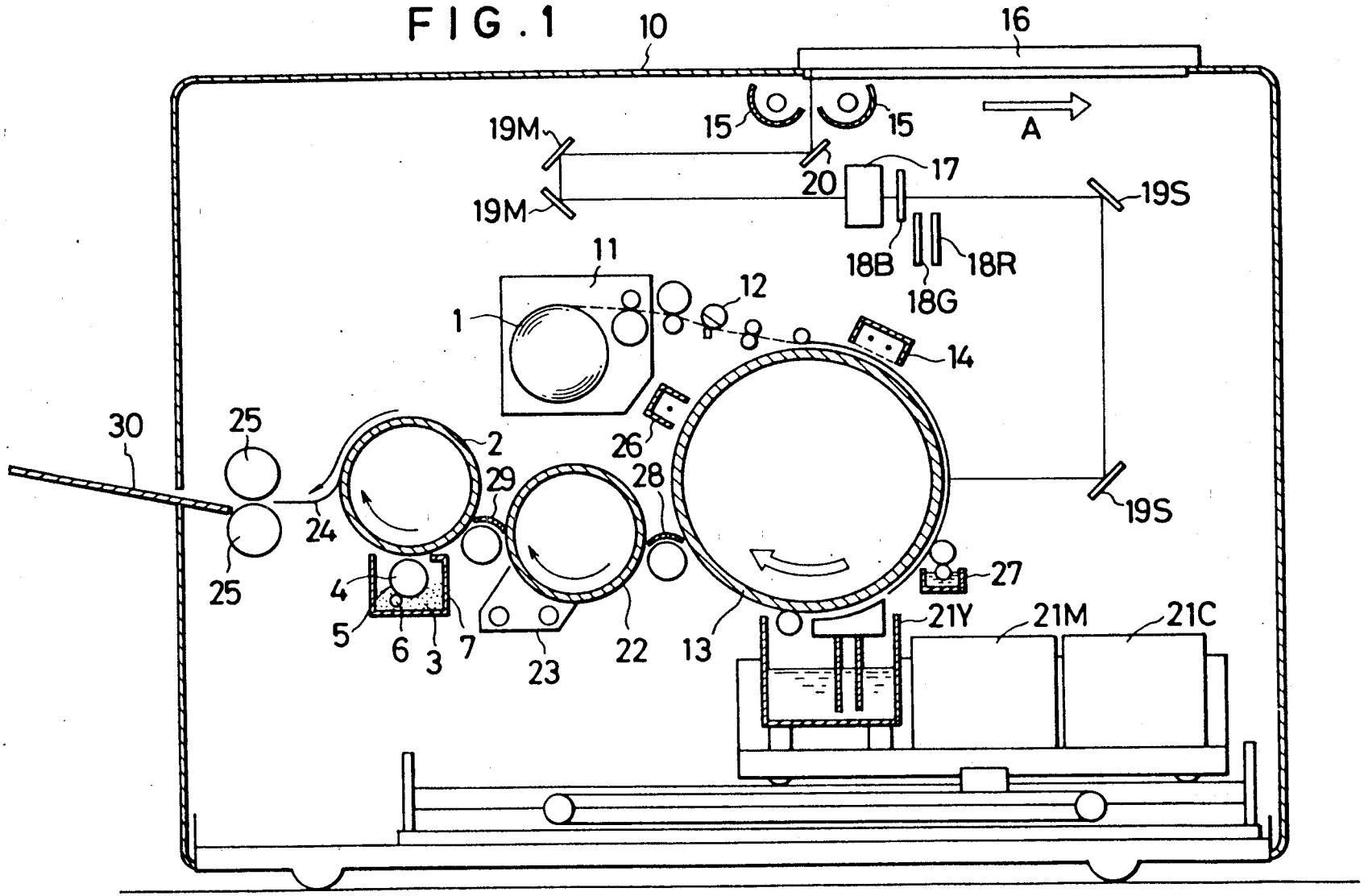
FIG. 1 is a schematic cross-sectional view showing an image recording apparatus provided with a coating device for forming a transparent protective resin layer according to a first embodiment of this invention.

Before entering description with respect to a coating device and method according to a first embodiment of this invention, a general structure of an image recording apparatus will first be described with reference to FIG. 1.

The image recording apparatus includes an outer frame 10 in which a rolled photosensitive sheet 1 is stored in a sheet roll case 11. The photosensitive sheet 1 per se has been known such that its photosensitive surface is formed by titanium oxide together with photosensitizers dispersed in a resin binder.

A stage drum 13 is rotatably disposed in the outer frame 10 for providing an intimate contact with the photosensitive sheet 1 with charged electricity and for forming an image on the sheet 1. The stage drum 13 is provided with a first fixing means for fixing a leading edge of the sheet 1. Further a second fixing means (not shown) is also provided in the stage drum 13 for fixing a tail edge of the sheet 1. For introducing the photosensitive sheet 1 into the stage drum 13, sheet guide rollers are disposed between the sheet roll case 11 and the stage drum 13, and a sheet cutter 12 is provided at that position for cutting the sheet 1 to define a sheet tail edge.

In the vicinity of the stage drum 13, a scorotron 14 is provided for uniformly charging a surface of the sheet 1 with electricity during rotation of the stage drum 13 in one direction (clockwise direction in FIG. 1). Further, at downstream side of the scorotron 14 with respect to the direction of rotation of the stage drum 13, a light containing color information is applied to the sheet 1 on the drum 13.

More specifically, at an upper portion of the internal space defined by the outer frame 10, an optical exposure means is provided. An original (not shown) is mounted on an original stand 16, and a light source 15 and a first mirror 20 are positioned immediately below the original stand 16. The light source 15 and the first mirror 20 are movable in a direction indicated by an arrow A at a speed synchronous with a rotation speed of the stage drum 13. Further, a pair of second mirrors 19M, 19M are provided which are movable in the direction A at a speed half the moving speed of the first mirror 20 and the light source 15. Therefore, a distance between the original and the stage drum 13 can be maintained unchanged. Further, a pair of third mirrors 19S, 19S are provided for directing a light from the light source to the photosensitive sheet 1 intimately mounted on the stage drum 13 through the first and second mirrors 20, and 19M, 19M. Further, a filter unit 17 containing a blue filter 18B, a green filter 18G and red filter 18R is provided between the second and third mirrors 19M and 19S. One of the filters is selectively movable toward and away from an optical path defined between the second and third mirrors. If the blue filter 18B is positioned on the optical path, only a blue color component in the light reflected from the original is focused on the photosensitive sheet 1 for forming an electrostatic latent image containing a blue color information.

At a position downstream of the exposure region of the stage drum 13, a prewetting means 27 is provided for filling minute holes in the photosensitive sheet with a filler formed of a solvent usable for toner liquid. Further, at a position downstream of the prewetting means 27 with respect to the rotational direction of the stage drum 13, provided is a wet type developing unit including yellow developer unit 21Y, magenta developer unit 21M and cyan developer unit 21C. One of these units is selectively moved toward and away from the developing section as shown.

A corona electricity eraser 26 is also positioned in confrontation with the stage drum 13 for erasing the charged electricity so as to perform subsequent exposure with a different color information. Furthermore, a separation blade 28 is provided at a position downstream of the developing unit for separating the photosensitive sheet 1 from the stage drum 13.

With the structure, the photosensitive sheet 1 is pulled out of the sheet roll case 1 and delivered into the stage drum 13 by way of guide rollers. The leading edge of the sheet 1 is fixed by the fixing means to the stage drum 13, and when the predetermined length of the sheet 1 is wound over the stage drum 13 in accordance with the rotation thereof, the sheet is cut by the cutter 12 so as to define the tail edge, which is also fixed to the stage drum 13 by the second fixing means. In this rotation, the sheet is uniformly charged with electricity by the scorotron 14, and is exposed to light which has been passed through the blue filter 18B for forming an electrostatic latent image on the sheet 1. Then, the sheet surface is subjected to filling with fillers for providing a smooth surface by the prewetting means 27, and thereafter, yellow color developing is carried out by the yellow developer unit 21Y. Subsequently, the sheet 1 carrying the yellow color image is subjected to electricity erasing treatment by the eraser 26.

The same is true with respect to the magenta color development using the green filter 18G and the cyan color development using the red filter 18R for providing a multicolor or full color image. Upon completion of such full color formation, the sheet 1 is removed from the stage drum 13 by the separation blade 28, and the sheet 1 is transferred onto a drying unit positioned beside the stage drum 13.

The drying unit includes a drying drum 22 provided with a sheet fixing means and a dryer 23 for applying hot air onto the sheet 1. A solvent remaining on the photosensitive sheet 1 is therefore removed therefrom. Upon completion of the drying, the sheet is removed from the drying drum 22 by a separation blade 29, and is transferred onto a transfer drum 2. The transfer drum 2 is provided with a suction means or gripping means for fixing the photosensitive sheet 1 onto a surface of the transfer drum 2.

Figure 2:
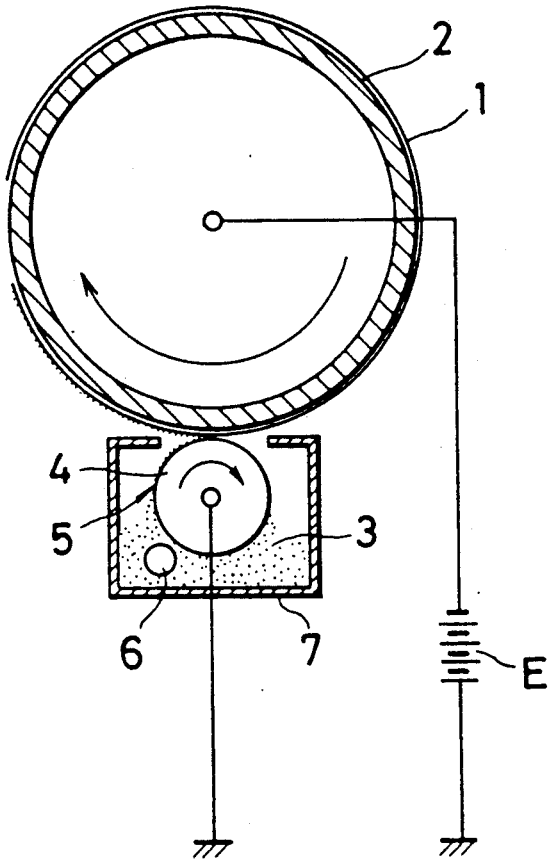
FIG. 2 is a schematic cross-sectional view showing the coating device according to the first embodiment of this invention.

A coating device for forming a transparent protective resin layer over the photosensitive sheet 1 according to a first embodiment of this invention will be described with reference to FIGS. 1 and 2. The coating device includes the transfer drum 2 and a resin particle application unit positioned in confrontation with the transfer drum 2.

The resin particle application unit includes a container body 7 for containing therein transparent resin particles 3, donor roller 4 and a feed roller 6 positioned within the container, and a blade 5. The donor roller 4 is positioned in confrontation with the transfer drum 2 and is spaced away from the photosensitive sheet 1 on the transfer drum 2 by a distance of from 0.05 to 5 mm, preferably from 0.5 to 3 mm. The feed roller 6 is spaced away from the donor roller 4 by a minute distance. The blade 5 is adapted to provide a constant thickness of the transparent resin particle layer over the donor roller 4. As best shown in FIG. 1, an electrical voltage is applied between the donor roller 4 and the transfer drum 2 for electrostatically attracting the transparent resin particles 3 onto the surface of the photosensitive sheet 1.

The transparent resin particles 3 have particle diameters ranging from 1 to 30 micron meters, and preferably from 8 to 15 micron meters. The transparent resin is selected from the group consisting of polystyrene, polymethyl methacrylate, a copolymer of styrene-n-butyl methacrylate, a resin of polyester group, and a resin of epoxy group. If desired, a charge controlling agent and additive can be added in the transparent resin particles. Materials of the resin particles are selected such that they are charged to a positive polarity.

With such an arrangement, in accordance with the rotations of the donor roller 4 and the feed roller 6, the resin particles 3 accumulated in the container 7 are adhered onto the surface of the donor roller 4 by means of a contact charging and frictional charging. In this case, the particle layer thickness is controlled by the blade 5. Because of the electrical voltage applied to the donor roller 4 and the transfer drum 2, the resin particle layer on the donor roller 4 is electrostatically transferred onto the transfer drum 2 having positive polarity. The thickness of the transparent resin layer on the photosensitive sheet 1 is determinative by a distance between the transfer drum 2 and the donor roller 4 and relative rotation speeds thereof. Preferable thickness of the particle layer is in a rage of from 5 to 100 micron meters, and more preferably 30 micron meters.

For separating the sheet 1 from the drum 2, a separation blade 24 is used. In this separation, the drum 2 is reversely rotated. The thus formed resin particle layer formed over the photosensitive sheet 1 is thermally fused by passing the sheet 1 through a thermal fixing roller 25, 25, so that the transparent resin particles 3 are meltingly bonded to one another for providing a uniform transparent resin layer which protects the imaging surface of the photosensitive sheet 1. Incidentally, a discharge tray 30 is provided for receiving a final sheet. The sheet is discharged onto the tray 30 with the imaging surface facing upwardly.

Figure 3:
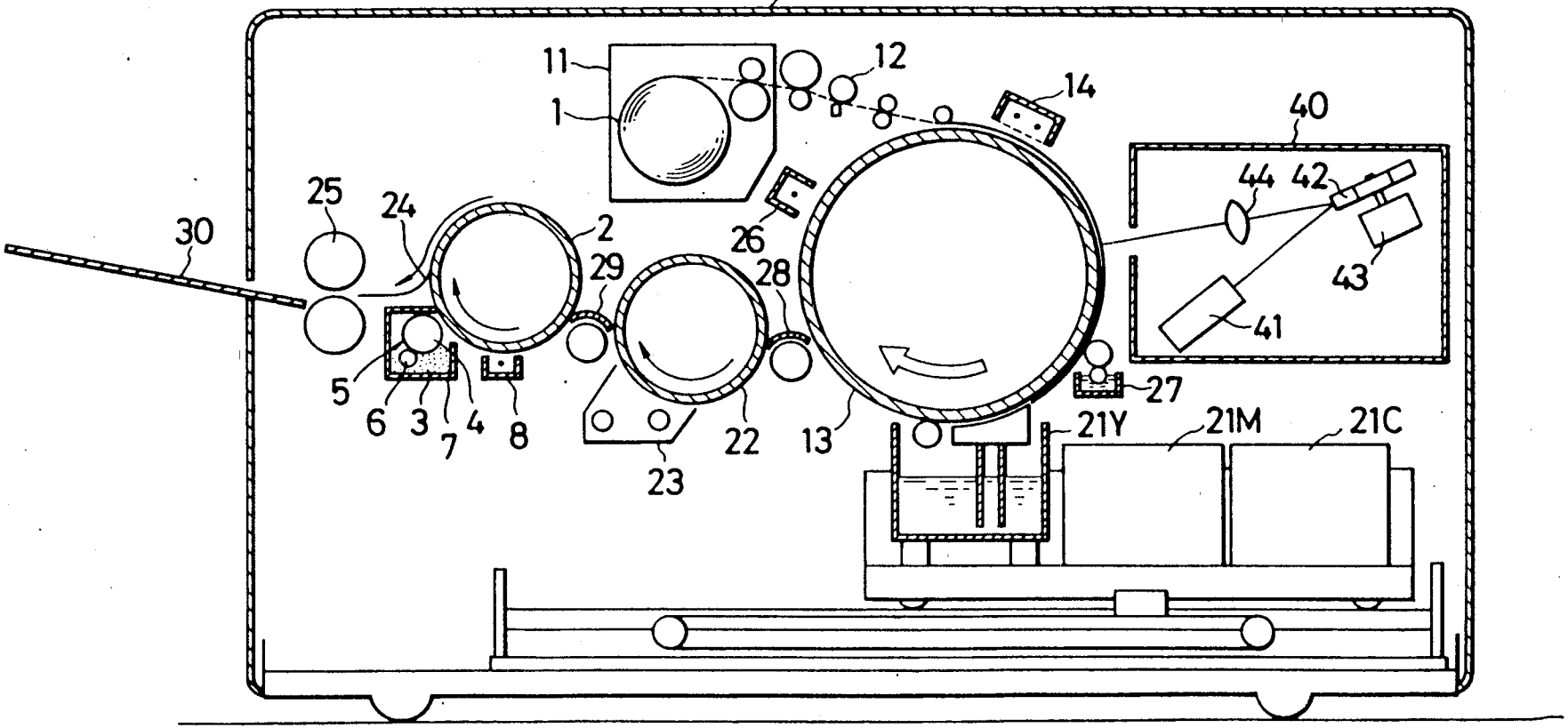
FIG. 3 is a schematic cross-sectional view showing another type of image recording apparatus having a coating device according to a second embodiment of this invention.

Another type of an image recording apparatus is shown in FIG. 3 wherein like parts and components are designated by the same reference numerals and characters as those shown in FIG. 1. In the apparatus shown in FIG. 3, a laser beam is employed for exposure. The laser beam has a wave length band available for the sensitivity of a photosensitive sheet 1.

The image recording apparatus has an exposure unit 40 including a conventional laser unit provided with a laser beam source 41, a polygon mirror 42 connected to a drive motor 43 for its high speed rotation, and a lens unit 44. The laser unit is operated in accordance with image information sent from a controlling means (not shown) for forming an electrostatic latent image on the photosensitive sheet uniformly charged with electricity.

Similar to the image recording apparatus shown in FIG. 1, the latent image is converted into a visible image upon developing operation. However, in the apparatus shown in FIG. 3, if a specific wavelength band is selectively used in the laser beam, which wavelength can provide less amount of absorption into the toner particles of the developing liquid, no specific requirement is caused with respect to an order of the developments. The steps of uniform charging, exposure to laser beam, and developing operation (and erasing operation) are repeatedly carried out for forming a full color image on the photosensitive sheet 1. Then, the sheet 1 undergoes drying and then subjected to resin particle coating process by a coating device for forming a transparent resin layer over the sheet 1 according to the second embodiment of this invention.

The coating device includes a transfer drum 2 and a resin particle application unit having a container 7, a donor roller 4, a feed roller 6 and a blade 5 those similar to the first embodiment. However, in the second embodiment, a corotron 8 is further provided for uniformly charging the photosensitive sheet 1 on the transfer drum 2. Further, transparent resin particles 3 accumulated in the container 5 is charged with electricity having polarity different from that of the photosensitive sheet 1. The resin particles on the donor roller 4 are electrostatically transferred onto the surface of the photosensitive sheet 1. Subsequent process are the same as those in the first embodiment.

Figure 4:
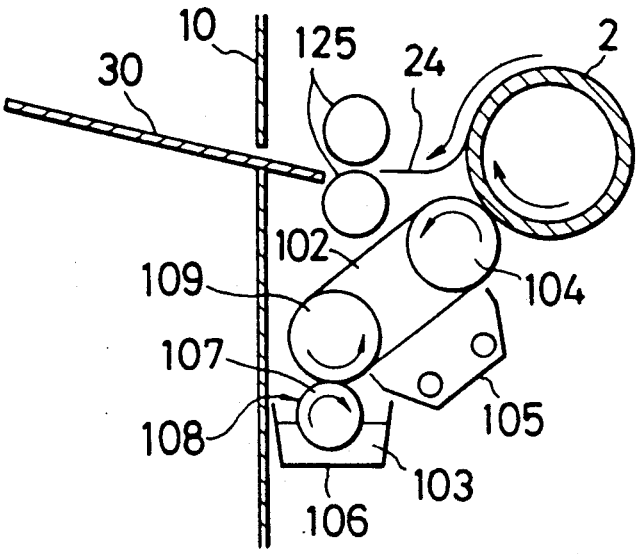
FIG. 4 is a schematic cross-sectional view showing a coating device for forming a transparent protective resin layer according to a third embodiment of this invention.

A coating device for forming a transparent protective resin layer over the photosensitive sheet 1 according to a third embodiment of this invention will be described with reference to FIG. 4 wherein like parts and components are designated by the same reference numerals as those shown in the foregoing embodiments. In this embodiment, the coating device is assembled in the image recording apparatus shown in FIG. 1. Further, the coating device employs resin solution for forming a transparent protective resin layer over the imaging surface of a photosensitive sheet 1 instead of the employment of the resin particles those used in the foregoing embodiments.

More specifically, the coating device includes a transfer drum 2 and a resin solution application unit. The latter unit includes coating liquid conveying means, means for forming a coating liquid layer on the coating liquid conveying means, and means for applying at least one of heat and pressure to the coating liquid layer on the conveying means in order to transfer the layer onto the photosensitive sheet 1 on the transfer drum 2.

The coating liquid conveying means includes an endless belt 102 mounted on rollers 109 and 104.

The means for forming a coating liquid layer on the coating liquid conveying means includes a coating means and an evaporation means. The coating means includes a pan 106 for accumulating therein the resin solution 103, a gravure roll 107 rotatably dipped in the resin solution, a blade 108 positioned adjacent the gravure roll 107 for regulating adhesion amount of the resin solution onto the gravure roll 107. The gravure roll 107 is provided at a position in contact with the endless belt 102 of the conveying means, i.e., in the vicinity of the roller 109. The evaporation means is adapted for evaporating a solution or dispersive liquid of the resin solution coated on the conveying means. For this, a dryer 105 is positioned in confrontation with the endless belt 102.

The means for applying at least one of heat and pressure to the coating liquid layer is provided by the roll 104 positioned in confrontation with the transfer drum 2. The roll 104 serves as a transfer roller for transferring the coating layer on the endless belt 102 onto the photosensitive sheet 1 on the transfer drum 2 by a heat applied thereto and/or pressure provided between the roller 104 and the transfer drum 2.

Various kinds of coating liquid 103 are available in this third embodiment as far as it can form a transparent thermoplastic resin coating layer upon evaporation of a solvent or water. For example, available are (a) thermoplastic resin solution which is transparent and soluble in a solvent such as a polymethyle methacrylate and polystyrene, (b) a solution mixture of a first resin such as polyvinyl butyral which per se has insufficient thermoplastic property and an elastomer such as rosin derivative and ester gum those being phase solved with the first resin and providing transparency and thermoplastic property, (c) aqueous resin solution such as polyethylene oxide, aqueous polyester and aqueous acryl, and (d) emulsion such as ionomer resin and a copolymer of etylene-vinyl acetate.

In the third embodiment, a predetermined amount of the resin solution 103 accumulated in the pan 106 is adhered to the gravure roll 107, so that the resin solution on the gravure roll 107 is directly transferred onto the endless belt 102, which is so called a direct gravure method. The resin solution layer formed on the endless belt 102 is then subjected to drying by the dryer 105, so that solvent or water in the resin solution is removed or evaporated for providing a transparent and thermoplastic resin layer. The resin layer on the belt 102 is brought into facial contact with the photosensitive sheet 1 on the transfer drum 2. In this case, since the roller 104 is heated, and if necessary, the transfer drum 2 is also heated, the resin layer on the endless belt 102 is pressurizingly transferred onto the photosensitive sheet 1. Consequently, the transparent protective resin layer is formed over the imaging surface of the photosensitive sheet 1. In this embodiment, a pair of rollers 125 are provided for discharging the sheet 1 onto a discharge tray 30. The rollers 125 are not thermal fixing rollers contrary to the rollers 25 in the first and second embodiments, since the transparent resin layer can already be formed on the transfer drum 2.

In the third embodiment, thermally fusable resin solution is used for forming the transferable resin layer. However, a dispersive liquid is also available. In the latter case, however, liquid agitation means is required for uniformly dispersing the dispersive agent. Further, the endless belt 102 is used as the conveying means. However, a cylindrical drum is also available instead of the endless belt.

Figure 5:
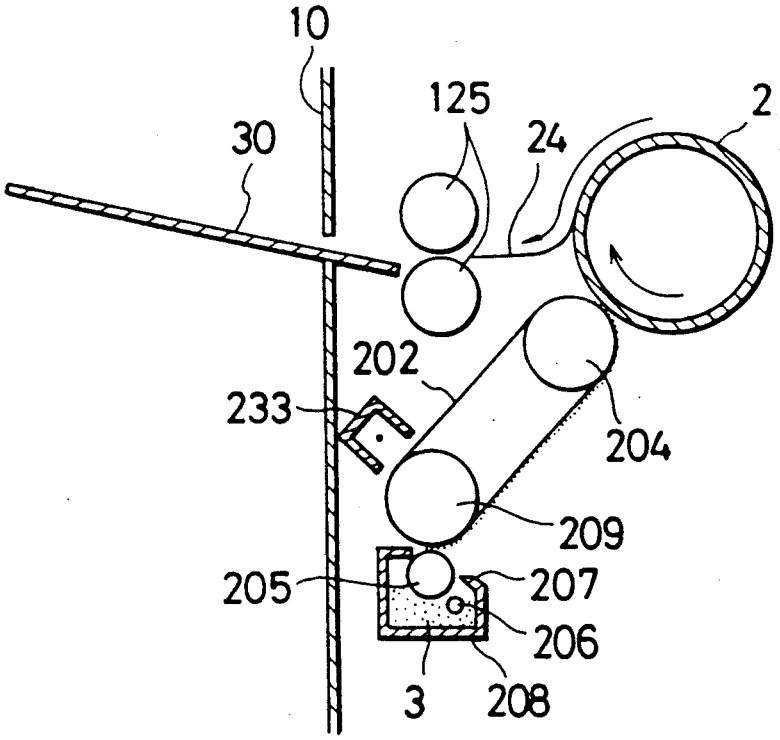
FIG. 5 is a schematic cross-sectional view showing a coating device for forming a transparent protective resin layer according to a fourth embodiment of this invention.

A coating device for forming a transparent protective resin layer over the photosensitive sheet 1 according to a fourth embodiment of this invention will be described with reference to FIG. 5 wherein like parts and components are designated by the same reference numerals as those shown in the foregoing embodiments. In this embodiment, the coating device is assembled in the image recording apparatus shown in FIG. 1. Further, the coating device employs resin particles similar to the first and second embodiments for forming a transparent protective resin layer over the imaging surface of a photosensitive sheet 1.

More specifically, the coating device includes a transfer drum 2 and a resin particle application unit. The latter unit includes resin particle conveying means, means for forming a resin particle layer on the resin particle conveying means, and means for applying at least one of heat and pressure to the resin particle layer on the conveying means in order to transfer the layer onto the photosensitive sheet 1 on the transfer drum 2.

The resin particle conveying means includes an endless belt 202 mounted on a backup roller 209 and a transfer roller 204. The endless belt 202 has a smooth flat surface and is formed of a dielectric material such as polyester and nylon. The resin particle conveying means also includes a corotron 233 disposed beside the endless belt for uniformly charging the belt surface.

The means for forming a resin particle layer on the conveying means includes a container 208 for accumulating therein the resin particles 3, a donor roller 205 rotatably disposed in the container 208, a feed roller 206 rotatably disposed for adhering the resin particles 3 onto the donor roller 205 by way of contact charging and frictional charging, and a blade 207 positioned adjacent the donor roller 205 for regulating adhesion amount of the resin particles onto the donor roller 207. Distance between the donor roller 205 and the endless belt 202 is in a range of from 0.05 to 5 mm. and preferably from 0.5 to 2 mm. Further, the direction of rotation of the donor roller 205 is opposite the direction of rotation of the backup roller 209 for forming large amount of resin particles onto the endless belt within a short period of time.

The means for applying at least one of heat and pressure to the resin particle layer is provided by the transfer roller 204 positioned in confrontation with the transfer drum 2. The roller 204 serves as a transfer roller for transferring the toner particle layer on the endless belt 202 onto the photosensitive sheet 1 on the transfer drum 2 by a heat applied thereto and/or pressure provided between the roller 104 and the transfer drum 2. For this, a heating means (not shown) is assembled within the roller 204 for heating the resin particles to their melting temperature. The transfer roller 204 is coupled to a drive means, so that the roller 204 is moved toward and away from the transfer drum 2.

In the fourth embodiment, the resin particles 3 accumulated in the container 208 are adhered to the donor roller 205 in accordance with the rotation of the feed roller 208 and the donor roller 205, while a thickness of the resin particle layer on the donor roller 205 is regulated by the blade 207. The particle layer on the donor roller 205 is then electrostatically transferred onto the endless belt 202 charged with electricity by the corotron 233. The thus transferred particle layer is moved toward the transfer roller 204 in accordance with the movement of the endless belt 202. Such process can be made concurrent with the image forming process carried out by the image recording apparatus shown in FIG. 1. When the photosensitive sheet 1 carrying thereon an output image is brought into fixing to the transfer drum 2, the belt 204 carrying thereon the resin particle layer is at its stand-by position where the layer is about to be transferred onto the imaging surface. Further, the transfer roller 204 already has its elevated temperature at which the toner particles can be melted.

For transferring the resin particle layer on the endless belt onto the imaging surface of the photosensitive sheet 1 on the transfer drum 2, the transfer roller 204 is moved toward the photosensitive sheet by the driving means (not shown) so that the resin particles 3 interposed between the endless belt 2 and the photosensitive sheet 1 are compressedly melted, whereby a transparent protective resin layer can be formed on the photosensitive sheet 1. In accordance with further rotations of the transfer drum 2 and with the further movement of the endless belt 202, the photosensitive sheet 1 is moved away from the belt 202, and the sheet 1 provided with the protective coating layer can be discharged onto the discharge tray 30 by way of a guide rollers 125.

In the foregoing embodiments, a photosensitive pressure sensitive recording medium is also available for forming an output image thereon instead of the photosensitive sheet for electrophotographic image formation. The transparent protective resin layer can be formed over the imaging surface of the photosensitive pressure sensitive recording medium.

While the invention has been described in detail and with reference to specific embodiments thereof, it would be apparent to those skilled in the art that various changes and modifications can be made therein without departing from the spirit and scope of the invention.

What is claimed is:

1. An image fixing device for fixing an output image on an imaging surface of an image recording medium by providing a transparent protective resin layer over the imaging surface, the device comprising;

means for mounting the recording medium with the imaging surface facing outwardly;

means for accumulating a material of the resin layer;

means for supplying the material on the accumulating means toward the imaging surface, the supplying means being positioned in the accumulating means; and means for applying the material onto the imaging surface, the applying means being positioned between the supplying means and mounting means;

wherein the material of the resin layer comprises resin particles.

2. The image fixing device as claimed in claim 1, wherein the supplying means comprises a resin particle container, a donor roller rotatably disposed in the container, a feed roller for feeding the resin particles onto the donor roller, and a blade positioned in confrontation with the donor roller for regulating adhesion amount of the resin particles on the donor roller, the donor roller being in confrontation with the mounting means.

3. The image fixing device as claimed in claim 2, wherein the donor roller has an outer peripheral surface on which the resin particles are adhered, a distance between the outer peripheral surface and the imaging surface of the recording medium mounted on the mounting means being in a range of from 0.05 to 5 mm.

4. The image fixing device as claimed in claim 3, wherein the distance is in a range of from 0.5 to 3 mm.

5. The image fixing device as claimed in claim 2, wherein the applying means comprises a voltage application means connected to the mounting means and the donor roller for electrostatically transferring the resin particles on the donor roller to the imaging surface of the recording medium.

6. The image fixing device as claimed in claim 2, wherein the applying means comprises a first charging means positioned in confrontation with the mounting means for charging the recording medium with one polarity, and a second charging means for charging the resin particles with an opposite polarity.

7. The image fixing device as claimed in claim 2, wherein the applying means comprises a resin particle conveying means, means for forming a resin particle layer on the resin particle conveying means, and means for applying at least one of heat and pressure to the resin particle layer on the conveying means for transferring the resin particle layer onto the imaging surface.

8. The image fixing device as claimed in claim 7, wherein the resin particle conveying means comprises a backup roller positioned in confrontation with the donor roller, a transfer roller positioned in confrontation with the image recording medium mounting means, an endless belt mounted between the backup roller and the transfer roller, and a charging means positioned in confrontation with the endless belt for uniformly charging the belt.

9. The image fixing device as claimed in claim 8, wherein the means for forming a resin particle layer comprises the donor roller having an outer peripheral surface, a distance between the outer peripheral surface of the donor roller and the endless belt being in a range of from 0.05 to 5 mm.

10. The image fixing device as claimed in claim 9, wherein the distance between the outer peripheral surface of the donor roller and the endless belt is in a range of from 0.5 to 2 mm.

11. The image fixing device as claimed in claim 8, wherein the means for applying at least one of heat and pressure comprises the transfer roller.

12. The image fixing device as claimed in claim 1, wherein the resin particles are selected from the group consisting of polystyrene, polymethyl methacrylate, a copolymer of styrene-n-butyl methacrylate, a resin of polyester group and a resin of epoxy group.

13. The image fixing device as claimed in claim 12, wherein the resin particles have particle diameters ranging from 1 to 30 micron meters.

14. The image fixing device as claimed in claim 13, wherein the resin particles have particle diameters ranging from 8 to 15 micron meters.

15. The image fixing device as claimed in claim 1, wherein the material of the resin layer comprises one of a resin solution and a resin dispersive liquid.

16. The image fixing device as claimed in claim 15, wherein the applying means comprises a coating liquid conveying means, means for forming a coating layer on the coating liquid conveying means, and means for applying at least one of heat and pressure to the coating layer on the conveying means for transferring the coating liquid layer onto the imaging surface of the image recording medium.

17. The image fixing device as claimed in claim 16; wherein the means for forming a coating layer comprises the supplying means for supplying the coating liquid onto the coating liquid conveying means, and a evaporation means positioned in confrontation with the coating liquid conveying means for evaporating a solution or dispersive liquid of the resin solution, the supplying means comprising a gravure roller.

18. The image fixing device as claimed in claim 17, wherein the coating liquid conveying means comprises a first roller positioned in confrontation with the gravure roller and a second roller positioned in confrontation with the image recording medium mounting means, and an endless belt mounted on the first and second rollers, and wherein the means for applying one of heat and pressure comprises the second roller.

19. An image fixing method for fixing an output image on an imaging surface of an image recording medium by providing a transparent protective resin layer over the imaging surface, the method comprising the steps of;

preparing resin particles as the material of the resin layer;

mounting the image recording medium on an image recording medium mounting means with the imaging surface facing outwardly;

applying a material of the resin layer over the imaging surface; and heating the material of the resin layer for providing an integral transparent resin layer over the imaging surface.

20. The method as claimed in claim 19, wherein the resin particles are electrostatically applied over the imaging surface.

* * * * *